US007264123B2

(12) United States Patent
Reed

(10) Patent No.: US 7,264,123 B2
(45) Date of Patent: Sep. 4, 2007

(54) CONTAINER AND METHOD OF CONTAINING

(76) Inventor: Thomas Reed, 922 E. Woodside, South Bend, IN (US) 46614

( * ) Notice: Subject to any disclaimer, the term of this patent is extended or adjusted under 35 U.S.C. 154(b) by 411 days.

(21) Appl. No.: 10/841,913

(22) Filed: May 10, 2004

(65) Prior Publication Data

US 2005/0247597 A1 Nov. 10, 2005

(51) Int. Cl.
*B65D 5/50* (2006.01)

(52) U.S. Cl. ..... 206/765; 206/472; 206/583; 229/164

(58) Field of Classification Search ..... 206/232, 206/472, 473, 474, 486, 583, 759, 763, 764, 206/765; 229/164, 921, 87.18, 87.19, 923
See application file for complete search history.

(56) References Cited

U.S. PATENT DOCUMENTS

| | | | | | |
|---|---|---|---|---|---|
| 2,522,049 | A | * | 9/1950 | Lang | 229/147 |
| 2,747,732 | A | * | 5/1956 | Fischer | 229/164 |
| 3,899,119 | A | * | 8/1975 | Roccaforte | 229/164 |
| 4,140,317 | A | | 2/1979 | Ramney | |
| 4,413,726 | A | * | 11/1983 | Davidson | 229/164 |
| 4,440,298 | A | | 4/1984 | Knight | |
| 4,840,275 | A | | 6/1989 | Faiola et al. | |
| 5,078,268 | A | * | 1/1992 | Olson et al. | 206/232 |
| 5,096,055 | A | * | 3/1992 | Opper | 229/164 |
| 5,232,087 | A | * | 8/1993 | Schluger | 206/232 |
| 5,794,631 | A | * | 8/1998 | Sylvester | 206/232 |
| 6,170,665 | B1 | | 1/2001 | Pehr | |
| 2002/0088204 | A1 | | 7/2002 | Dionisio | |
| 2002/0162757 | A1 | | 11/2002 | Parsons | |
| 2003/0034268 | A1 | | 2/2003 | Bonfils et al. | |
| 2003/0230501 | A1 | | 12/2003 | Smolev | |
| 2003/0234252 | A1 | | 12/2003 | Howard | |

* cited by examiner

*Primary Examiner*—Luan K. Bui
(74) *Attorney, Agent, or Firm*—Barnes & Thornburg LLP; Mark J. Nahnsen

(57) ABSTRACT

A container and a method of containing an accessory. The container comprises a base having an external side and a cover rotatably connected to the base. A rear wall connects to the base and the cover while a front wall positioned opposite the rear wall has a height smaller than the rear wall. The container further comprises an accessory holding structure rotatably connected to the base by the front wall. The accessory holding structure has at least one accessory holder wherein the at least one accessory holder integrally positions an accessory between the cover and the base. The method of containing comprises rotating an accessory holding structure over a base while placing an accessory in at least one accessory holder positioned in the accessory holding structure. Then the cover is rotated over the accessory to enclose the accessory between the base and the cover. Next, a set of distribution instructions are recorded on the base wherein the accessory is distributed while enclosed between the base and the cover based on the set of distribution instructions.

13 Claims, 7 Drawing Sheets

CONTAINER AND METHOD OF CONTAINING

BACKGROUND OF THE DISCLOSURE

The present disclosure relates to a container and a method of containing an accessory. In particular, the present disclosure relates to a container having a structure to hold the accessory within the container.

In the field of containers, various items are packaged for distribution and display in many different ways. Typically, containers merely cover the item for protection purposes. Although the container protects the item, the container prohibits access to the item unless the user separates the item from the container. Additionally, current containers require additional distribution materials such as mailing boxes and packaging materials for distribution. This arrangement, though, increases the manufacturing cost of the items since the container requires the mailing/packing materials which become disposable distribution pieces. The additional packaging arrangement also increases the cost and space needed for storage and shipping. Still further, this arrangement leads to unwieldy and bulky handling by the distributor due to the container incorporating the additional requisite packaging material.

For commercial success, containers must present a configuration which properly stores, displays and distributes the contained item in a cost efficient and user friendly manner. The success depends on factors such as manufacturing cost of the container, the functionality of the container, the distribution capability of the container, and the consumer acceptance of the container. Thus, the container should be cost effective, convenient, distributable and protective while presenting an aesthetic quality to the consumer. Additionally, the items should be integrally stored, distributed and displayed within the container for marketing advantages.

SUMMARY

The present disclosure relates to a container and a method of containing an accessory. In particular, the present disclosure relates to a container having a structure to integrally position the accessory within the container. Additionally, the present disclosure relates to a container having a distribution indicia member and other indicia members for distributing the container.

In an embodiment, the container comprises a base having an external side and a cover rotatably connected to the base. A rear wall connects to the base and the cover while a front wall positioned opposite the rear wall has a height smaller than the rear wall. The container further comprises an accessory holding structure rotatably connected to the base by the front the wall. The accessory holding structure has at least one accessory holder wherein the at least one accessory holder integrally positions an accessory between the cover and the base.

The present disclosure also embodies a method of containing comprising rotating an accessory holding structure over a base while placing an accessory in at least one accessory holder positioned in the accessory holding structure. Then, the cover is rotated over the accessory to enclose the accessory between the base and the cover. Next, a set of distribution instructions are recorded on the base wherein the accessory is distributed while enclosed between the base and the cover based on the set of distribution instructions.

DETAILED DESCRIPTION OF THE ILLUSTRATED EMBODIMENT

Figure 1:
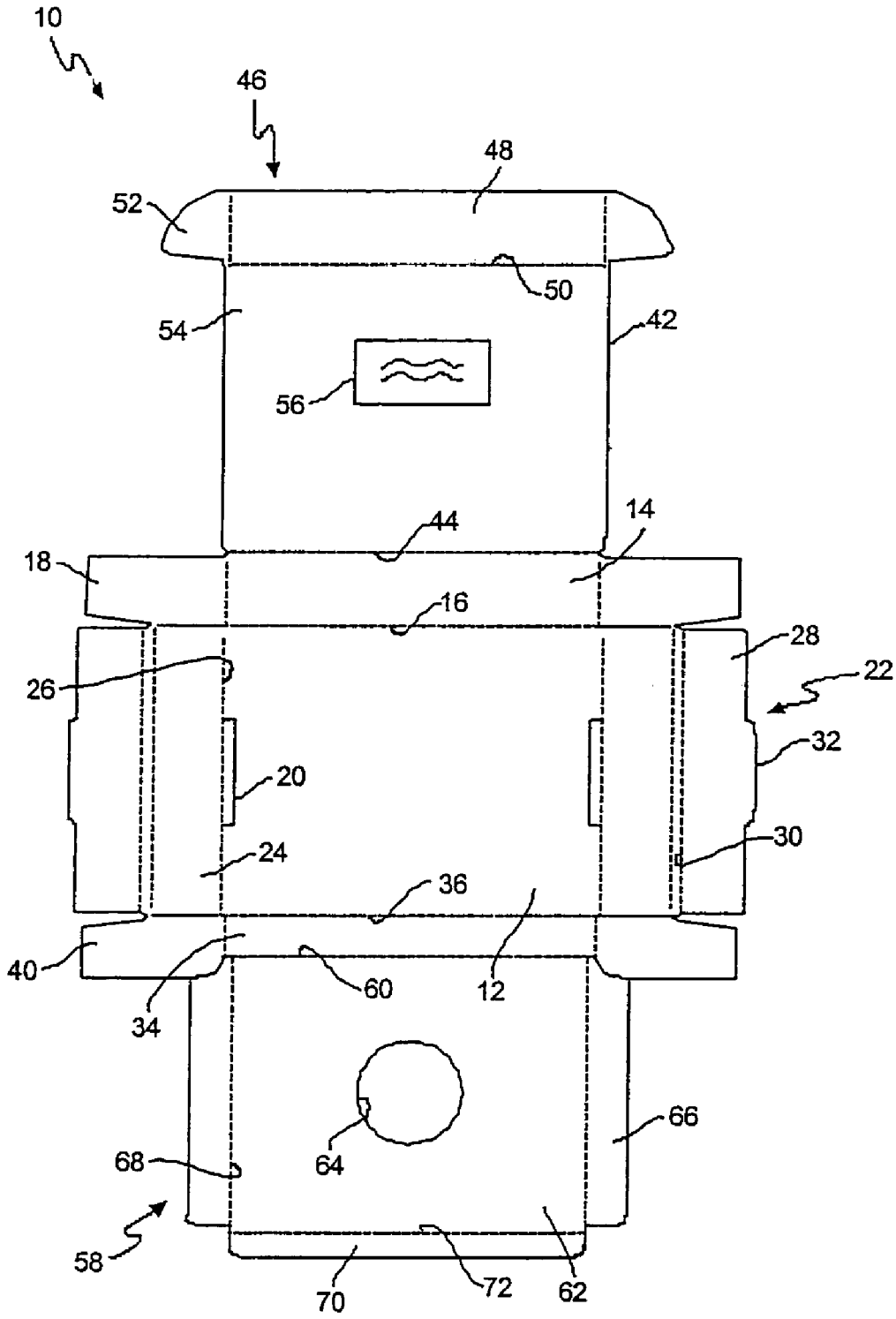
FIG. 1 is a plan view of a blank of the present disclosure illustrating an accessory holding structure.

The present disclosure relates to a container and a method of containing an accessory. In particular, the present disclosure relates to a container having a structure to integrally position the accessory within the container. Additionally, the present disclosure relates to a container having a distribution indicia member and other indicia members for distributing the container.

It is noted that the container of the present disclosure may be bilaterally symmetrical. Therefore, pairs of opposing like components are to be found, with one item of the pair on each side of the blank or container. For simplicity of labeling, each component of the opposing pair will have the same reference numeral. Also, a pair may be indicated by a numeral on one side of the drawing only. Where this occurs, it is to be understood that the discussion also applies to the corresponding component on the other side, even though that component may not be numerically labeled.

Referring to FIG. 1, an exemplary embodiment of a blank for a container 10 is shown in a plan view. The container 10 includes a base 12 and a rear wall 14 rotatably attached to the base 12 at a rear wall fold line 16. The base 12 may comprise a variety of configurations such as a square like configuration. The base 12 may also comprise other symmetrical and non-symmetrical configurations. Rear wall 14 incorporates left and right rear ends 18 wherein the rear ends 18 hinge to the rear wall 14 at opposite ends of the rear wall 14. The rear ends 18 remain free from attachment to the base 12. The base 12 also includes base notches 20 positioned perpendicular to the rear wall 14.

The container 10 further includes side wall structures 22 oppositely positioned from each other via the base 12. Each side wall structure 22 includes a first side wall 24 rotatably attached to the base 12 at a first side wall fold line 26. The first side wall fold lines 26 extend along the length of the side wall 24, perpendicular to the rear wall 14. Each side wall 24 remains disconnected from the rear ends 18. Each side wall structure 22 further includes a second side wall 28 rotatably attached to the first side wall 24 at a second side wall fold line 30. The second side wall fold line 30 extends parallel to first side wall fold line 26. The second side walls 28 further include tabs 32 extending outward from the second side walls 28.

As illustrated in FIG. 1, the container 10 further includes a front wall 34 rotatably attached to the base 12 at a front wall fold line 36, which runs parallel to the rear wall fold line 16. The front wall 34 has a shorter height than the rear wall 14. Additionally, front ends 40 rotatably connect to the front wall 34 at opposite ends of the front wall 34. Similar to the rear ends 18, the front ends 40 remain free from attachment to the base 12.

The container 10 further includes a cover 42 rotatably attached to the rear wall 14 at a cover fold line 44 which runs parallel to the rear wall fold line 16. The cover 42, though, is separated from the rear ends 18 as shown in FIG. 1. The cover 42 is positioned opposite the front wall 34 with respect to the base 12. The cover 42 may comprise a variety of configurations such as a square like configuration. The cover 42 may also comprise other symmetrical and non-symmetrical configurations.

The cover 42 comprises a cover wall structure 46 which includes a cover wall 48 rotatably connected to the cover 42 at a cover wall fold line 50 which runs parallel to the rear wall fold line 16. The cover wall structure 46 also includes cover tabs 52 rotatably attached to the cover wall 48 to extend beyond the cover wall 48. In an embodiment, the cover tabs 52 extend perpendicularly outward from the cover wall 48. The cover 42 further includes an inner side 54 which includes an inner indicia member 56. The inner indicia member 56 positions an area for displaying messages such as greetings.

The container 10 further includes an accessory holding structure 58 rotatably attached to the front wall 34 at an accessory fold line 60 which runs parallel to the front wall fold line 36. The accessory holding structure 58 may comprise a variety of configurations such as a square like configuration. The accessory holding structure 58 includes an accessory base 62 having at least one accessory holder 64 positioned within the accessory base 62. In an embodiment, the at least one accessory holder 64 is positioned through the accessory base 62. As such, the accessory holder 64 is integral with the accessory base 62. The at least one accessory holder 64 may comprise a variety of configurations. In an embodiment, the accessory holder 64 may comprise a circular configuration.

The accessory holding structure 58 further includes accessory sides 66 rotatably attached to the accessory base 62 by accessory fold lines 68. The accessory sides 66 are positioned opposite each other with respect to the accessory base 62 and are positioned perpendicular to the front wall 34 wherein the accessory sides 66 are the same height as the front wall 34. The accessory holding structure 58 also includes an accessory wall 70 rotatably connected to the accessory base 62 by an accessory front fold line 72 which runs parallel to the accessory fold line 60. The accessory wall 70 is the same height as the accessory sides 66.

Figure 2:
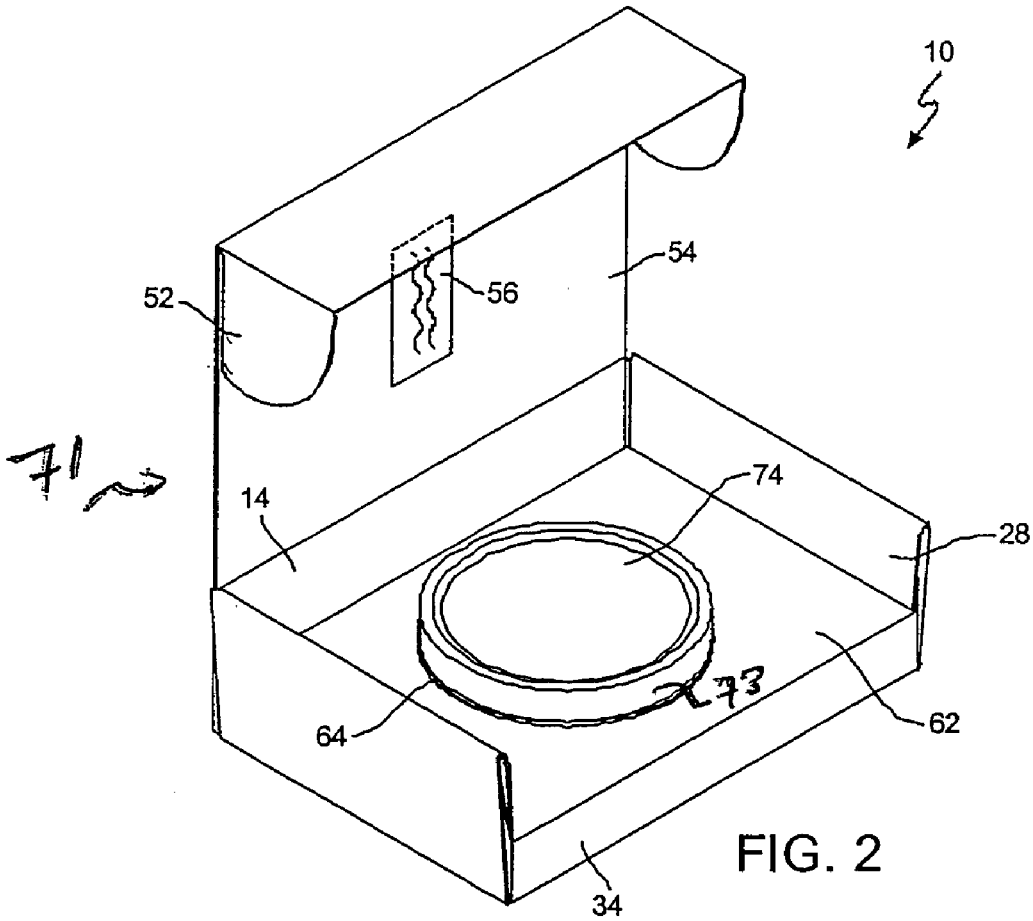
FIG. 2 is a perspective view of the container in an open position formed from the blank of FIG. 1 illustrating an accessory positioned with in the accessory holding structure.

Turning to FIG. 2, the container 10 is shown perspectively in an open position 71 wherein the at least one accessory holder 64 positions an accessory 74 integral with the accessory base 62. The accessory 74 may include any suitable product such as but not limited to a gift container, a candle, or a food package. In the open position 71, the accessory holder 64 integrally positions the accessory 74 in an accessible position since the front wall 34 has a shorter height than the rear wall 14. As such, the accessory 74 in the open position 71 is protected by the second side walls 28 (in a folded position) and the rear wall 14. Thus, an accessory side 73 of the accessory 74 is exposed in the open position 71. Additionally, as shown in the open position 71, the inner side 54 displays the inner indicia member 56.

Figure 3:
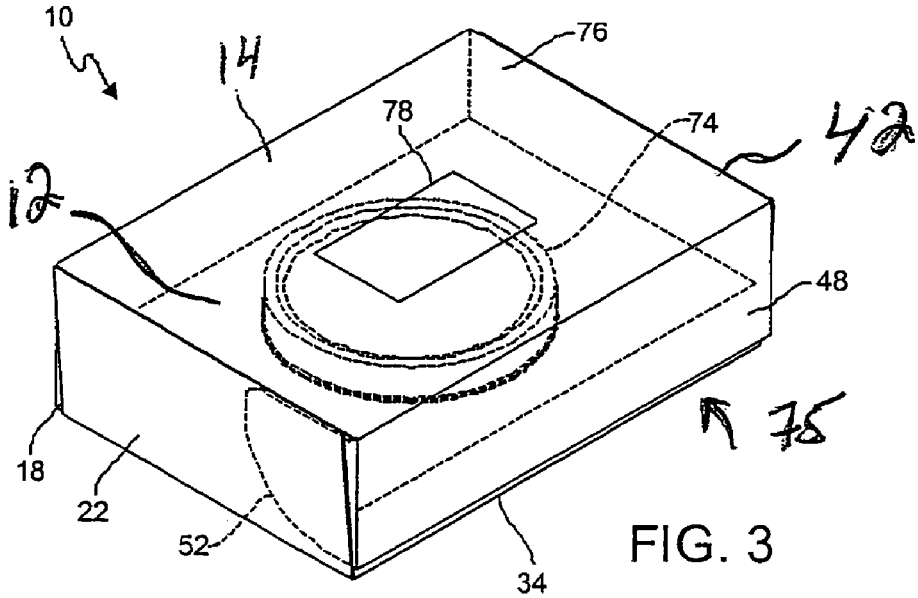
FIG. 3 is a perspective view of the container of FIG. 2 in a closed position.

Turning to FIG. 3, the container 10 is shown perspectively in a closed position 75. As such, the cover 42 is configured to rotate between the open position 71 and the closed position 75. In this configuration, the cover 42 and the cover wall 48 form an enclosure with respect to the rear wall 14, side wall structures 22 and the front wall 34 wherein the cover wall 48 overlaps the front wall 38. In this configuration, the cover tabs 52 insert within the side wall structures 22. Additionally, an outer indicia member 78 is integrally positioned on an outer side 76 of the cover 42.

As shown in FIG. 3, the at least one accessory holder 64 integrally positions the accessory 74 between the cover 42 and the base 12, wherein the at least one accessory holder 64 suspends the accessory 74 over the base 12. In an embodiment, the at least one accessory holder 64 positions the accessory 74 to contact the inner side 54 (shown in FIG. 2) in the closed position 75. As such, the accessory 74 is configured to support the cover 46. In another embodiment, the at least one accessory holder 64 positions the accessory 74 free from contacting the inner side 54.

Figure 4:
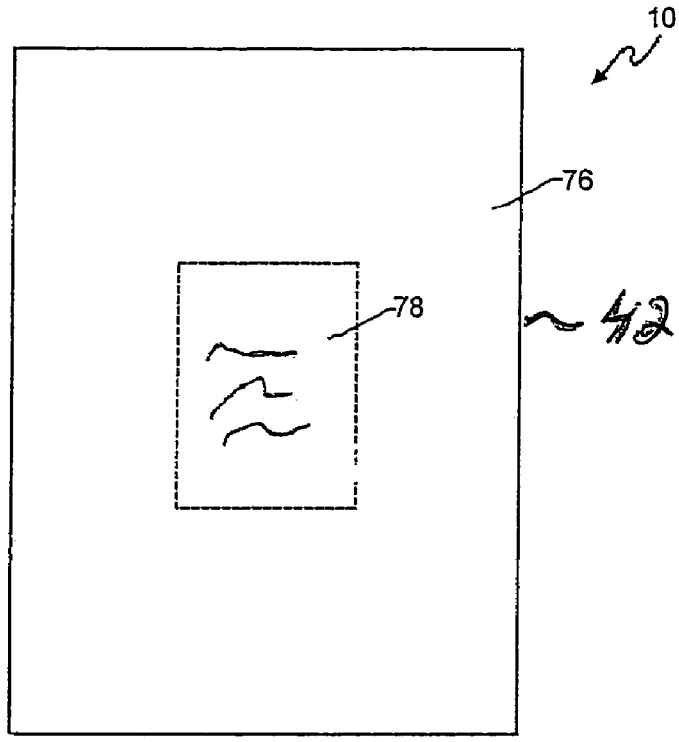
FIG. 4 is a front view of the container of FIG. 1 illustrating an outer indicia member.

Turning to FIG. 4, the container 10 is shown in a front elevational view. In this view, the cover 42 displays the outer side 76 which includes outer indicia member 78. The outer indicia member 78 provides an area for displaying messages such as greetings. In an embodiment, the outer indicia member 78 is adapted to display greetings such as a greeting card. In an embodiment, the message of the outer indicia member 78 relates to the message of the inner indicia member 56 (FIG. 2). For example, the outer indicia member 78 may read "Thank You . . . " and the inner indicia member 56 may read ". . . for being a friend."

Figure 5:
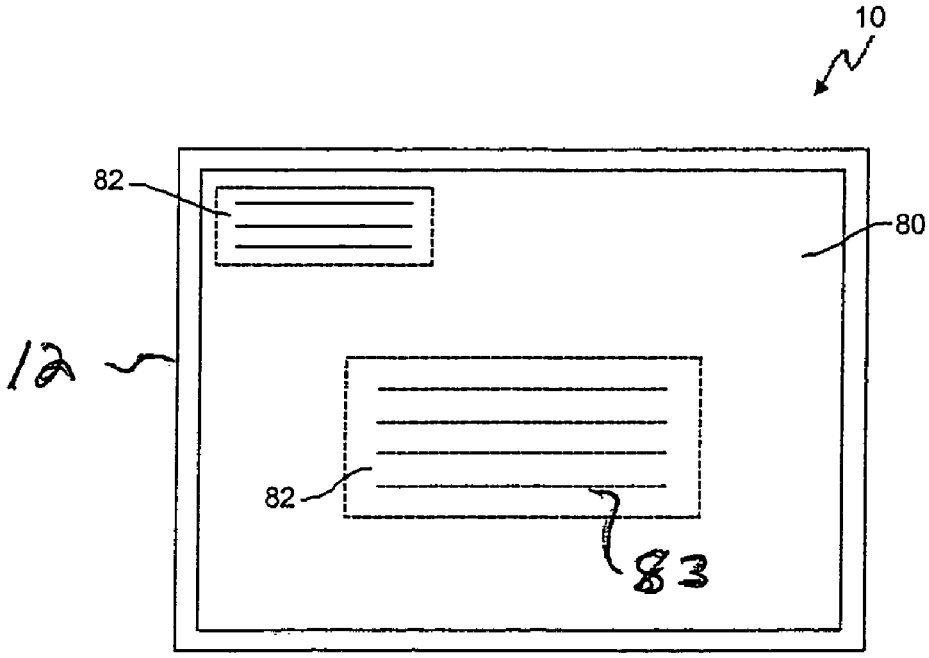
FIG. 5 is a back view of the container of FIG. 1 illustrating a distribution indicia member.

Turning to FIG. 5, the container 10 is shown in a back elevational view, wherein the base 12 includes an external side 80. A distribution indicia member 82, integral with the external side 80, provides a space for recording a set of distribution instructions 83 such as contact information and mailing information. In an embodiment, the set of distribution instructions 83 displays delivery and return addresses. For example, the set of distribution instructions 83 may display a fill in the blanks area for mailing information. In an embodiment, the set of distribution instructions 83 may display product information, inventory information or catalog information.

Figure 6:
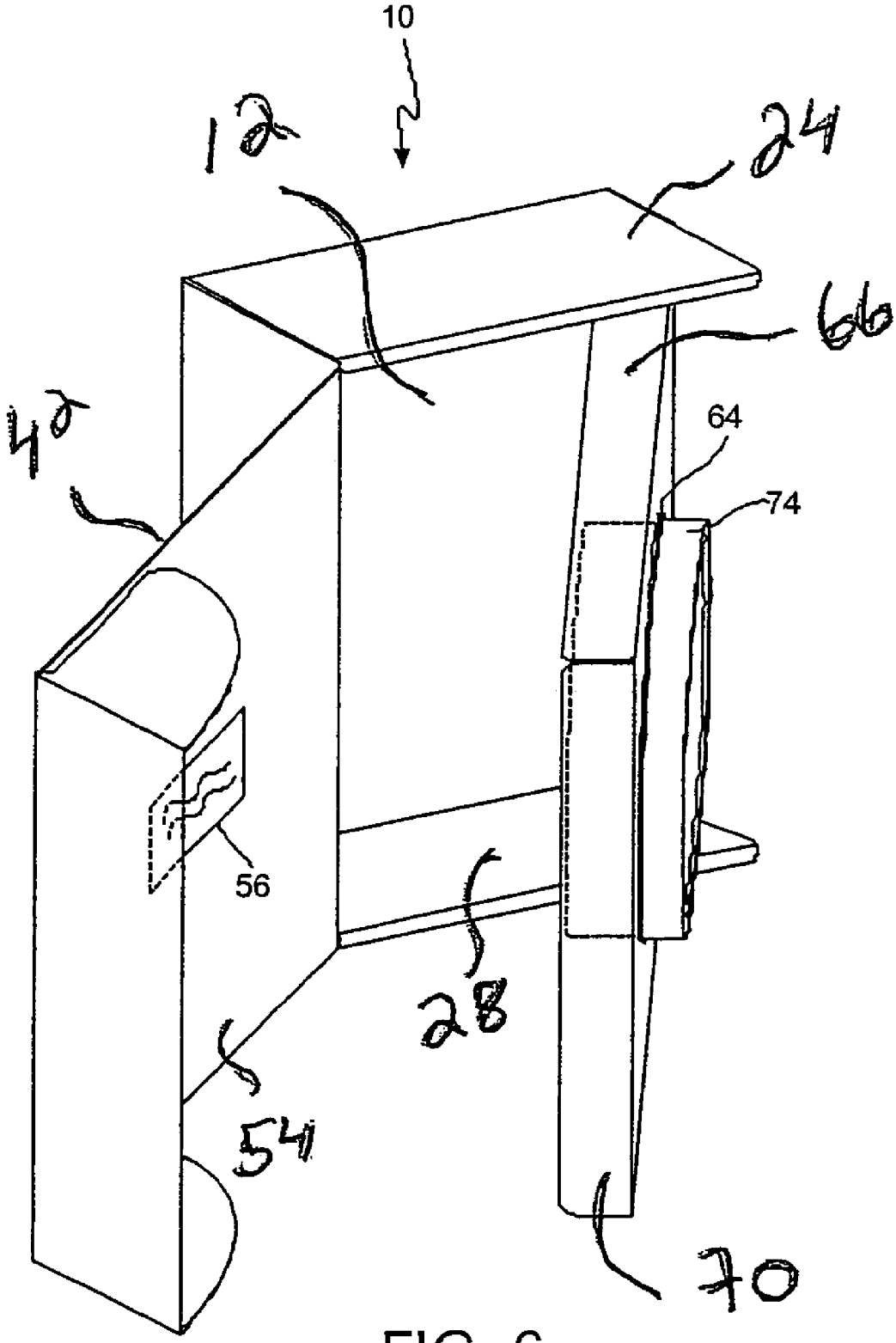
FIG. 6 is a perspective view of a method of use of the container of FIG. 2 holding the accessory.

Turning to FIG. 6 and referring to FIGS. 1-5, the user, during use, inwardly rotates the rear wall 14 perpendicular with respect to the base 12 along the rear wall fold line 16. Moving the rear wall 14 to the perpendicular position also rotates the rear ends 18 perpendicular to the base 12. Next, the user inwardly rotates the rear ends 18 toward the base 12 and perpendicular to the rear wall 14. Additionally, the user inwardly and upwardly rotates the front ends 40 toward the base 12. In this position, the front ends 40 are positioned co-planar with the rear ends 18 and perpendicular to the rear wall 14. The user then inwardly rotates the first side walls 24 perpendicular to the base 12 along the first side wall fold line 26. Next, the user rotates the second side walls 28 over the front ends 40 via the second side wall fold lines 30. In this position, the second side walls 30 co-planarly face the first side walls 24. The second side walls 28 are rotated to a position co-planar with the first side walls 24 to form a double thickness top area which supports the cover 42 in the closed position 75, as will be discussed. While covering the front ends 40, the user inserts the tabs 32 into the respective base notches 20 to stabilize the side wall structures 22.

The accessory holding structure 58 is rotated along the front wall fold line 36 over the base 12 while the cover 42 remains in the open position 71. The accessory sides 66 and the accessory wall 70 are also inwardly rotated perpendicular to the accessory base 62 along the accessory side lines 68 and accessory wall fold line 72 respectively. The user then places the accessory 74 into the at least one accessory holder 64. In this position, the at least one accessory holder 64 suspends the accessory 74 over the base 12 while exposing the accessory side 73 of the accessory 74 since the front wall 34 is shorter than the rear wall 14, first side walls 24 and second side walls 28.

The user then inwardly rotates the cover 42 along the cover fold line 44 while inwardly rotating the cover wall 48 along the cover fold line 50. In this position, the cover 42 is configured to lay over the accessory holding structure 58 to enclose the accessory 74 between the base 12 and the cover 42 in the closed position 75. The double thickness of the first side walls 24 and the second side walls 28 provide support for the cover 42 in the closed position 75. In an embodiment, the accessory 74 is configured within the at least one accessory holder 64 to contact the inner side 54 to support the cover 42. In another embodiment, a space exists between the accessory 74 and the inner side 54. Next the cover tabs 52 insert within the front ends 40 and cover structures 22 to stabilize the cover 42 with the base 12. As such, the accessory 74 is integrally positioned within the container 10. The present disclosure is not limited to the described order of assembly steps and may include a variety of sequences for assembly steps.

With the container 10 positioning the accessory 74 for convenient display which protects the accessory 74, the user may display greetings directly on the container 10 via the inner indicia member 56 and the outer indicia member 78. Then the user may record the set of distribution instructions 83 such as mailing information directly on the distribution indicia member 82 positioned on the external side 80 of the base 12. Accordingly, the user may distribute, such as by mail, the container 10 without incorporating packaging materials. Furthermore, a receiver simply rotates the cover 42 to expose the accessory 74 for convenient removal from the accessory holding structure 58. As such, the container 10 of the present disclosure displays and protects the accessory 74 while simultaneously providing a distribution of the accessory 74 via the distribution indicia member 82.

Figure 7:
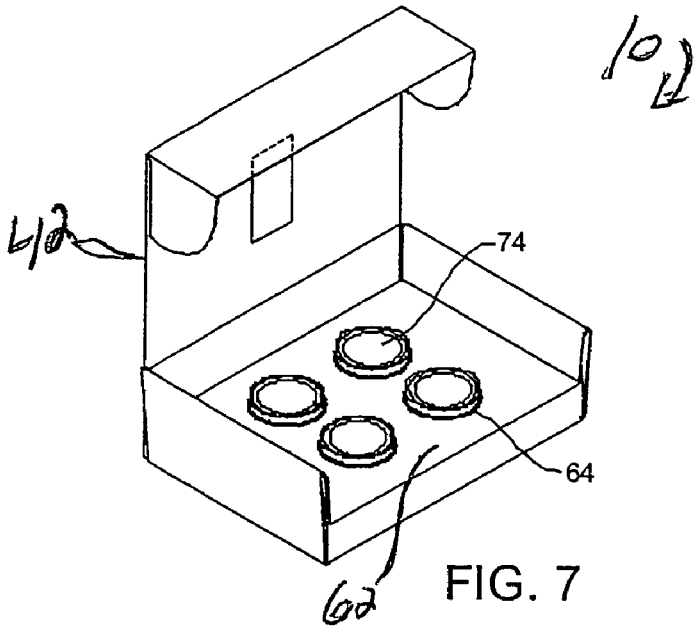
FIG. 7 is a perspective view of another container embodiment holding accessories.
Figure 8:
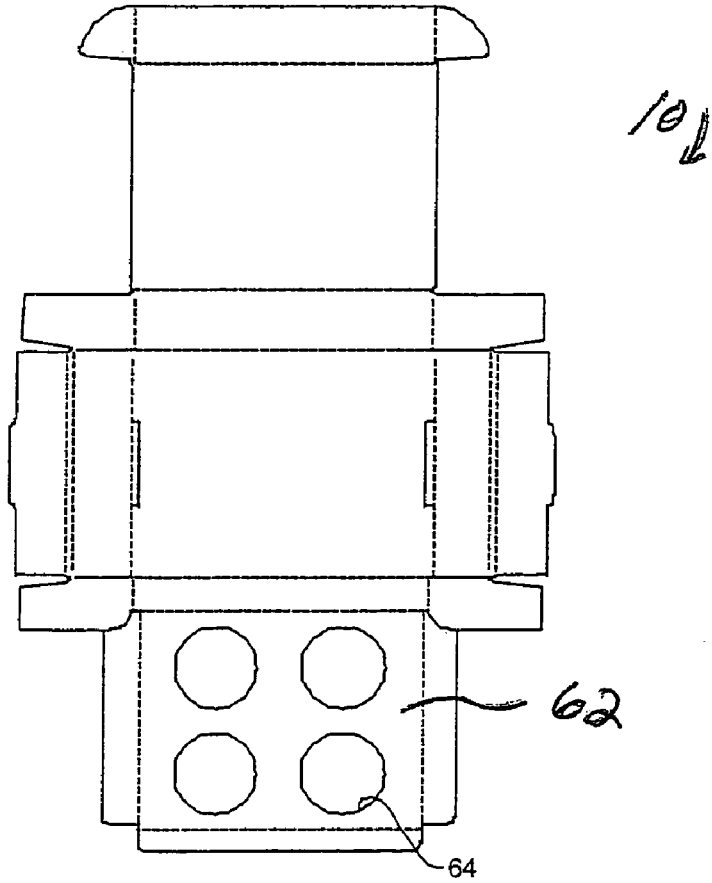
FIG. 8 is a plan view of a blank for the container of FIG. 7.

Turning to FIG. 7, the container 10 is shown in an embodiment where the at least one accessory holder 64 includes multiple accessory holders 64, such as four positioned throughout the accessories base 62. In this embodiment, the accessory holder 64 integrally positions the accessories 74 under the cover 42. FIG. 8 illustrates the blank for the container 10 of FIG. 7. As illustrated, the accessory holders 64 are positioned through the accessory base 62.

Figure 9:
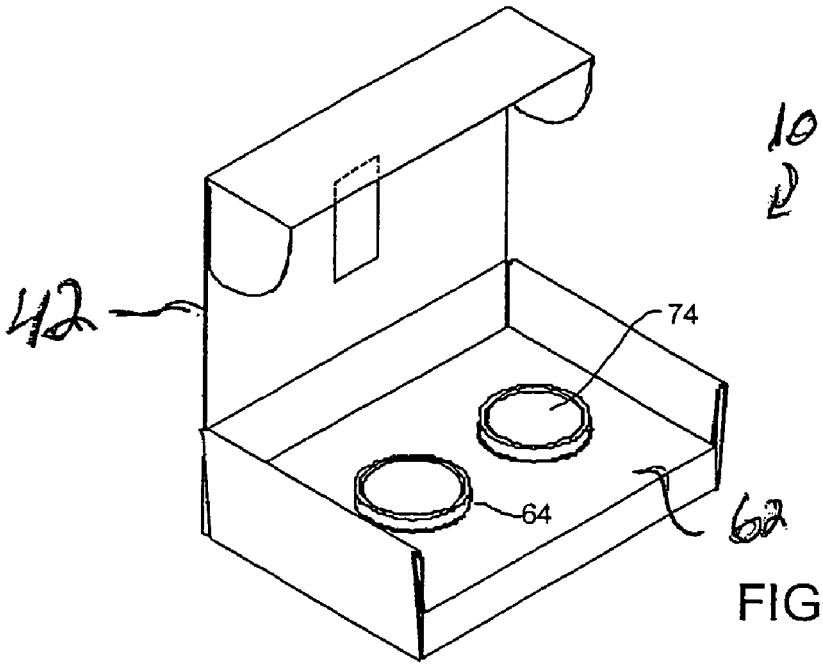
FIG. 9 is a perspective view of another container embodiment holding accessories.
Figure 10:
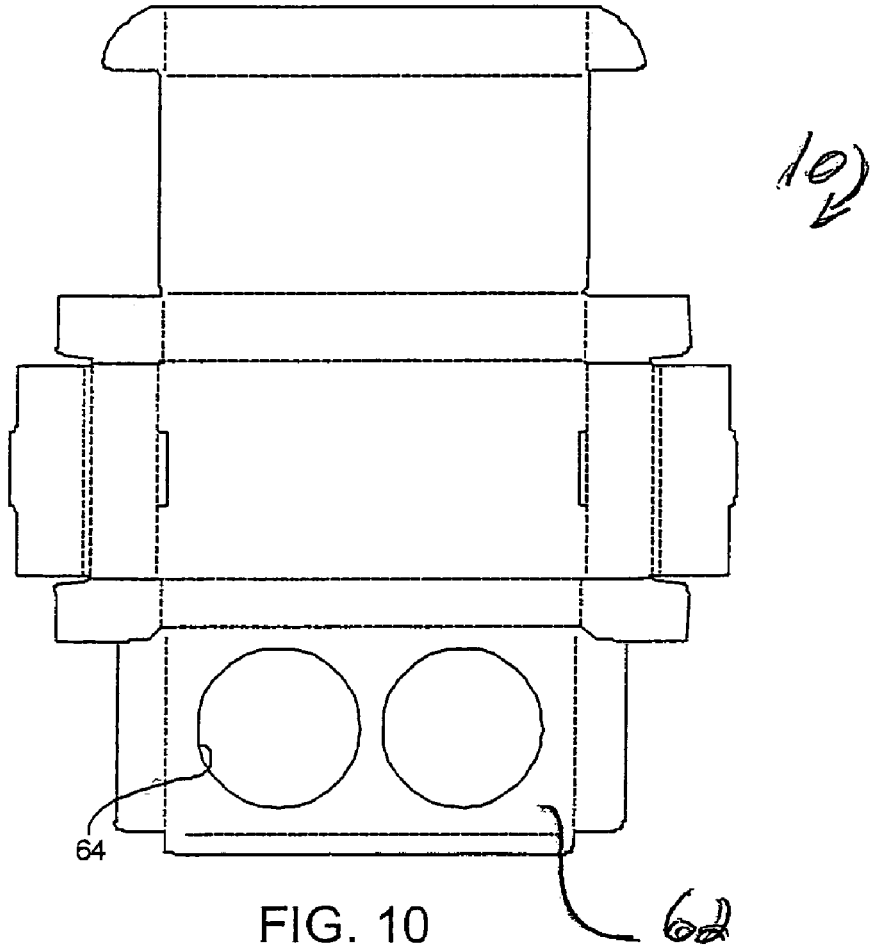
FIG. 10 is a plan view of a blank for the container of FIG. 9.

Turning to FIG. 9, the container is shown in an embodiment wherein the at least one accessory holder 64 includes multiple accessory holders 64, such as two positioned throughout the accessory base 62. In this embodiment, the accessory holders 64 integrally position the accessories 74 under the cover 42. FIG. 10 illustrates the blank of the container 10 of FIG. 9. As illustrated, the accessory holders 64 are positioned through the accessory base 62.

Figure 11:
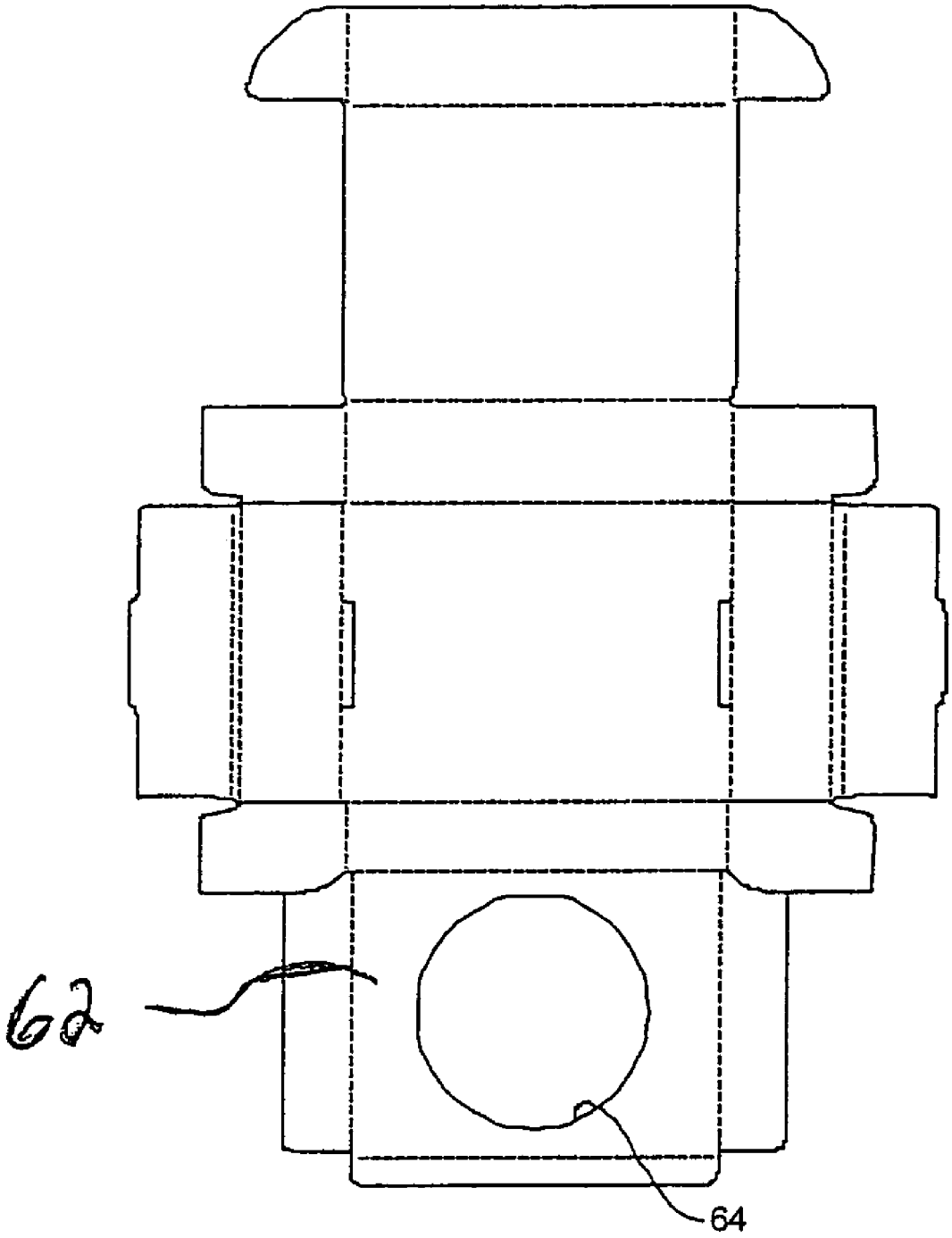
FIG. 11 is a plan view of a blank for another container embodiment.

Turning to FIG. 11, the blank of another embodiment for the container 10 illustrates the at least one accessory holder 64 positioned through the accessory base 62. In this embodiment, the accessory holder 64 substantially incorporates the surface area of the accessory base 62 to accommodate larger accessories 74 (not shown).

While the concepts of the present disclosure have been illustrated and described in detail in the drawings and foregoing description, such an illustration and description is to be considered as exemplary and not restrictive in character, it being understood that only the illustrative embodiments have been shown and described and that all changes and modifications that come within the spirit of the disclosure are desired to be protected by the following claims.

I claim:

1. A container, comprising:

a base having a pair of upstanding side walls of substantially the same height and formed to include a pair of slots, the base portion having an external side;

a cover rotatably coupled to the base, the cover including top wall and a front wall rotatably coupled to the top wall;

a pair of cover tabs rotatably coupled to the front wall, the tabs adapted to be positioned within the slots of the side walls when the cover is in a closed position on the base;

a rear wall of substantially the same height as the side walls, the rear wall coupled to, the side walls and the cover; and a front wall positioned opposite the rear wall, the front wall having a height smaller than the height of the rear wall and the side walls and wherein a portion of the front wall of the cover covers the front wall when the cover is in the closed position;

an accessory holding structure rotatably connected to the base by the front wall, the accessory holding structure having at least one accessory holder, the at least one accessory holder adapted to integrally position an accessory between the cover and the base.

2. The container according to claim 1, further comprising a distribution indicia member.

3. The container according to claim 2, wherein the distribution indicia member is integrally positioned on the external side.

4. The container according to claim 1, further comprising an outer indicia member.

5. The container according to claim 4, wherein the outer indicia member is integrally positioned on an outer side of the cover.

6. The container according to claim 1, further comprising an inner indicia member integrally positioned on an inner side of the cover.

7. The container according to claim 1, wherein the cover is rotatably configured to reciprocate between an open position and a closed position.

8. The container according to claim 7, wherein the cover in the closed position is adapted to cover it accessory.

9. The container according to claim 1, wherein the at least one accessory holder is adapted to suspend the accessory over the base.

10. A self distributing container which protects and delivers an accessory, comprising:

a base having a pair of upstanding sidedwalls of substantially the same height and formed to include a pair of slots, the base portion having an external side;

a cover rotatably coupled to the base, the cover including a top wall and a front wall rotatably coupled to the top wall;

a pair of cover tabs rotatably coupled to the front wall, the tabs adapted to be positioned within the slots of the side walls when the cover is in a closed position on the base;

a rear wall of substantially the same height as the side walls, the rear wall coupled to the side walls and the cover;

a front wall positioned opposite the rear wall, the front wall having a height smaller than the height of the rear wall and the side walls and wherein a portion of the front wall of the cover covers the front wall of the base when the cover is in the closed position;

an accessory holding structure rotatably connected to the base by the front wall, the accessory holding structure having at least one accessory holder which is adapted to integrally suspend the accessory between the cover and the base; and a distribution indicia member positioned on the external side wherein the distribution indicia member is configured to record a set of distribution instructions to distribute the container to a location.

11. The container according to claim 10, wherein the cover is rotatably configured to reciprocate between an open position and a closed position.

12. The container according to claim 11, wherein the cover in the closed position is adapted to cover the accessory.

13. The container according to claim 10, wherein the at least one accessory holder is adapted to suspend the accessory over the base.

* * * * *